United States Patent [19]

Clamage

[11] 4,142,012

[45] Feb. 27, 1979

[54] TREE SIMULATIVE DISPLAY

[76] Inventor: Herbert M. Clamage, 9627 Kildare, Skokie, Ill. 60076

[21] Appl. No.: 908,067

[22] Filed: May 22, 1978

[51] Int. Cl.[2] ..... A47G 33/06

[52] U.S. Cl. ..... 428/8; 211/107; 248/512; 428/20

[58] Field of Search ..... D11/118; 362/123; 248/27.8, 314, 512, 538; 211/107, 196, 205; 428/8, 18, 19, 20

[56] References Cited

U.S. PATENT DOCUMENTS

| | | | |
|---|---|---|---|
| 503,708 | 8/1893 | Ross | D11/118 X |
| 1,999,005 | 4/1935 | Gerondale | 428/8 |
| 2,550,023 | 4/1951 | Reilly | 248/314 X |
| 3,135,389 | 6/1964 | Farley | D11/118 X |
| 3,692,617 | 9/1972 | Marks et al. | 428/20 |

*Primary Examiner*—Henry F. Epstein

*Attorney, Agent, or Firm*—Silverman, Cass & Singer, Ltd.

[57] ABSTRACT

A tree simulative display which includes a metal stand having a vertical standard and plural tiers each carrying plural conical branch holders on a ring, the tiers being secured to the standard spaced along the length thereof. Preserved natural foliage branches are seated in each of the holders to complete the display. The tier of branch holders is formed preferably by arranging plural holders in plural trident like array, three on a metal stem, the stems weldably secured to the metal rings about the inner circumference thereof. Alternately, a secondary support ring may be weldably secured to each tier about the stems and between the holders and the associated ring. The display is topped off with single holders carried by a ring secured to the upper end of the standard. A holder may be secured to the top of the standard. Branch holders may be oriented angularly at will merely by bending same.

15 Claims, 9 Drawing Figures

FIG. 6
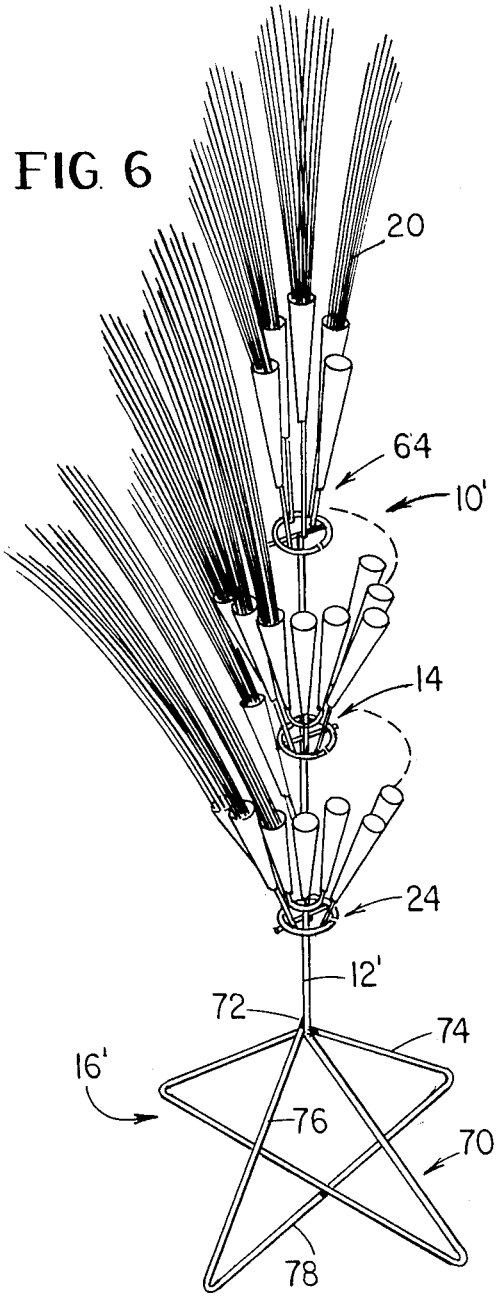
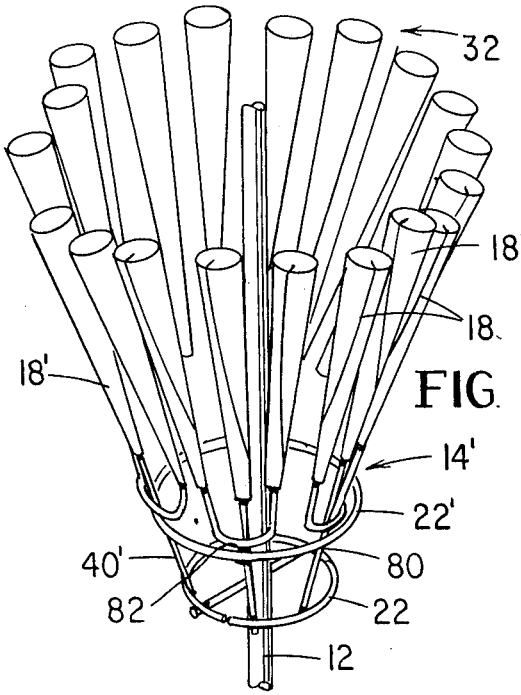
FIG. 7
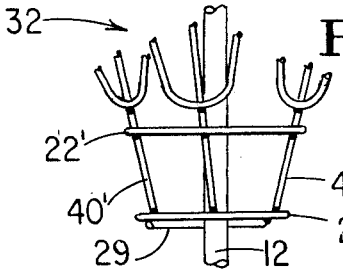
FIG. 8
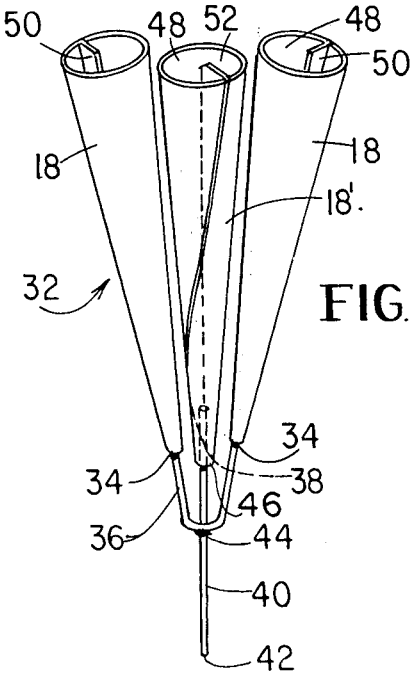
FIG. 9

TREE SIMULATIVE DISPLAY

BACKGROUND OF THE INVENTION

This invention relates generally to knockdown tree simulative display arrangements such as employed as Christmas trees and more particularly provides a tree simulating arrangement employing a rigid standard having tiers of branch holders, each tier fixedly secured to the standard along the length thereof, preserved natural foliage branches removably seated within said holders, and a base for receiving said standard, said holders positioned whereby the appearance of a natural tree is simulated when the holders are filled.

Use of natural evergreen trees, particularly as Christmas displays, meet the desirability of tradition, natural beauty, color, foliage and esthetic effect to achieve a long standing popularity as Christmas decorative structures. Notwithstanding their traditional acceptance and popularity, many disadvantages are encountered which tend to deter the use of natural flora for such display purposes and raise the desire for artificial displays. Among these disadvantages are included perishability, disposal problems, including fire dangers inherent as a result of the natural tree drying out after minimal use, a very short useful life, brittleness on aging, etc. Natural foliage is characterized by its non-uniformity, characteristic color, irregular branch arrangement, etc.

Artificial tree display arrangements have been provided which are simulative of natural flora counterparts. These displays are expensive, non-traditional, are not satisfactorily stable, are incapable of being decorated traditionally and possess a uniformity and regularity of branch appearance which detract from their "lifelike" appearance.

Known artificial tree arrangements require much expenditure of time and effort in assembly and disassembly. Standards used generally are prebored for receipt of branch ends. Many arrangements require different length branches which are coded and the assembly of which require a predetermined order for installation. Structures offering equal length branches require precisely sequentially angled passageways to be formed in a predetermined pattern in the standard. Often, the branch ends break or splinter. Splinters are encountered as a result of drilling branch holding bores in the standard. Where metal is used, metal particles are encountered which are undesirable.

Although the available displays are attractive and have been widely accepted, a display truly simulative of the natural foliage in color, attitude, texture, orientation of foliage and non-uniformity of the branch arrangement relative to the standard so as to be more simulative of the naturally occurring tree has yet to be available. Efforts to provide a display closely simulative of a natural tree have not been successful.

Stability, durability, permanence, long useful life, reusability, fire and electrical safety while achieving the attitude and configuration of the natural flora would be desirable for tree simulative display structures. In addition, displays which are versatile and which can be made to simulate a variety of natural trees without undue expense, special tools and dies, molds, etc., would fulfil an unmet need. Ease of set-up and knockdown also is a highly desirable factor to be achieved since the present tedious effort required in assembly and disassembly is a factor which deters displays other than naturally occurring flora. Elimination of those other disadvantages of artificial displays referenced above likewise would have considerable advantage to the user.

SUMMARY OF THE INVENTION

A tree simulative display having tiers of holders mounted on rings weldably secured along the length of a metal standard, a base for receiving said standard in vertical orientation. Each ring includes a crossbar permanently secured thereacross to define a passage accommodating the standard. Preserved, dyed natural foliage branches are each received within a holder. The holders are secured to the rings yet are capable of being selectively oriented angularly relative to the standard by bending of their stems relative to the rings to which they are secured. Preferably, the holders are grouped in threes, one pair being secured to the opposite ends of a U-shaped rod and an inner holder secured intermediate said pair, to define a trident-like arrangement. The base includes a braced, vertically oriented tubular member of size and configuration telescopically to receive the lower end of the standard. An additional support ring may be used welded to the stems of the holders above the first ring and surrounding the stems.

BRIEF DESCRIPTION OF THE DRAWINGS

FIG. 6 is a perspective view of a modified embodiment of the invention;

FIG. 7 is a perspective view similar to that of FIG. 3 but illustrates a modified tier of holders installed on a standard;

FIG. 8 is a fragmentary view of the tier illustrated in FIG. 7, and

FIG. 9 is a further enlarged view of one of the holders forming the tiers of FIG. 3.

DESCRIPTION OF THE PREFERRED EMBODIMENTS

Figure 1:
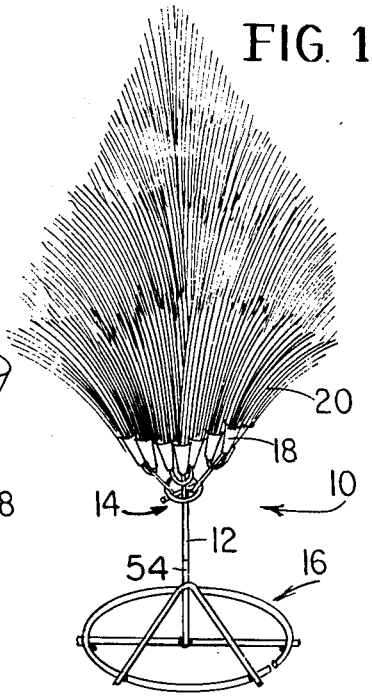
FIG. 1 is a reduced perspective of a tree simulative display arrangement embodying the invention herein, shown fully assembled.
Figure 2:
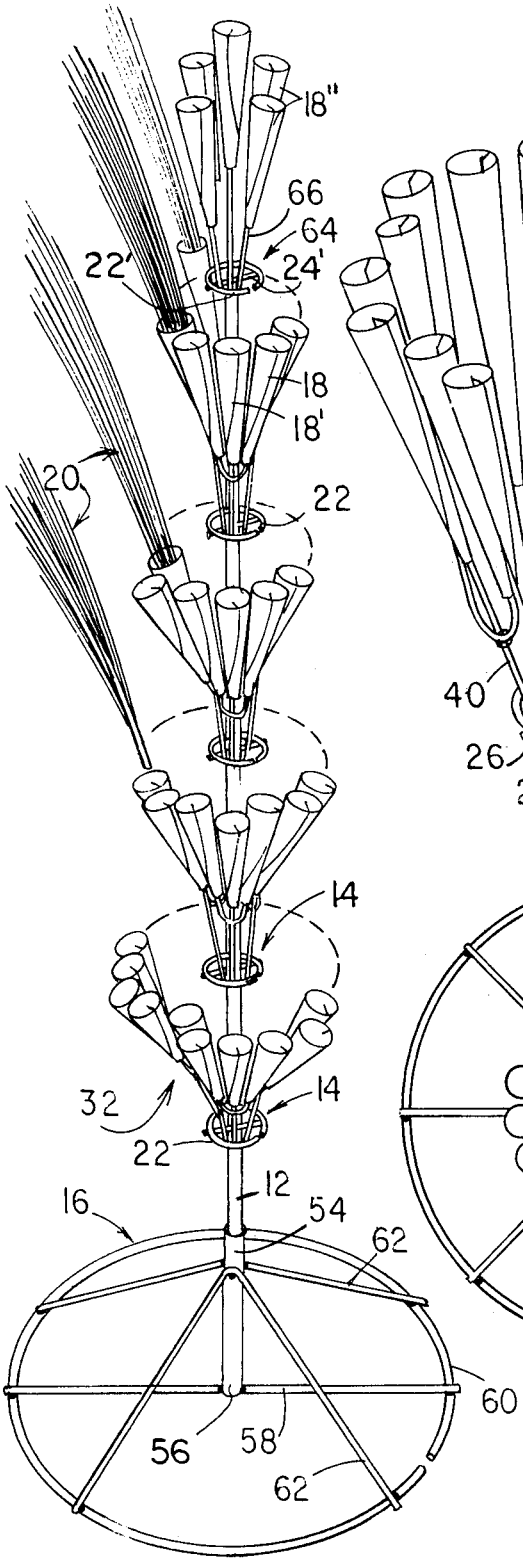
FIG. 2 is an enlarged perspective view of the tree simulative display of FIG. 1 shown in the process of being assembled.
Figure 3:
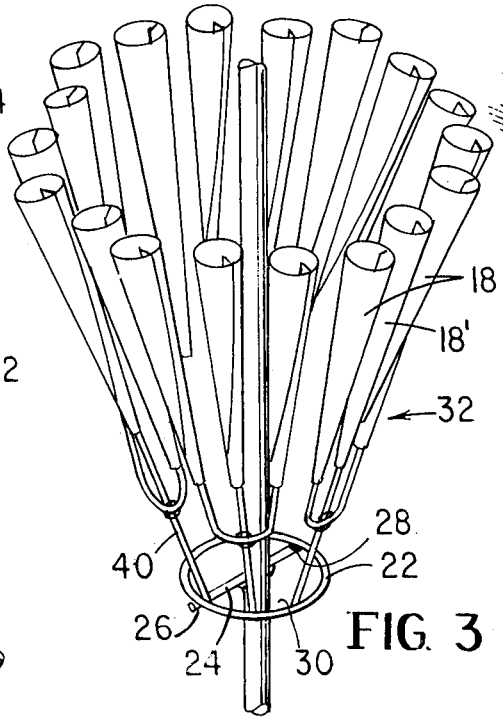
FIG. 3 is a further enlarged perspective view of one tier of holders.
Figure 4:
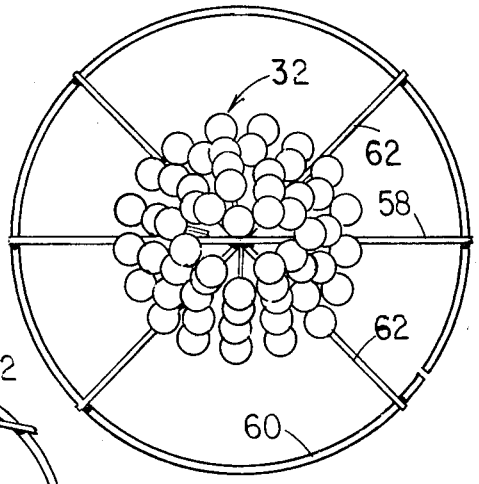
FIG. 4 is a top view of the tree simulative display of FIG. 2.
Figure 5:
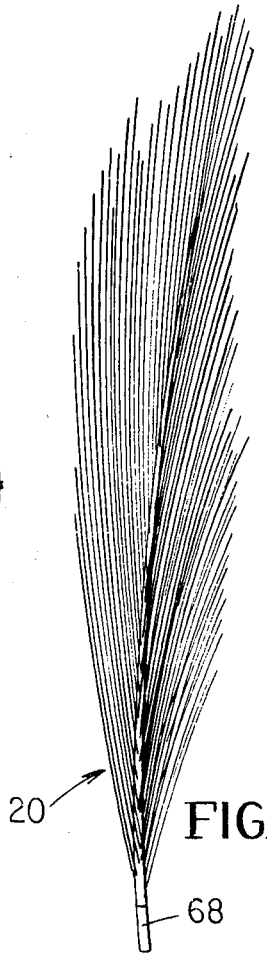
FIG. 5 is a view of the support stand illustrating the preserved foliage branch of preserved foliage used to complete the tree simulative display.

Referring now to the drawings, a knockdown tree simulative display according to the invention herein is illustrated in FIG. 1 and is designated generally by reference character 10. The display 10 comprises a standard 12 carrying a plurality of tiers 14 of branch holders 18 spaced along the length of the standard 12. The standard 12 is seated telescopically in base 16. Each individual holder 18 carries a natural foliage branch 20 seated therein, said branch 20 being a naturally occurring cut branch that has been treated with a dye and a chemical preservative whereby materially to retard the natural deterioration of the branch subsequent to severance from its natural habitat.

The standard 12 is formed of an elongage metal tube. Each of the tiers 14 includes a support ring 22 having a crossbar 24 weldably secured thereto at its two intersections with ring 22, as shown at 26 and 28. The crossbar 24 is offset relative to the center of the ring 22 so as to define a passage 30 of size sufficient to accommodate the standard 12 therethrough.

Each of the tiers 14 carry a plurality of assemblies 32 of holders 18, each assembly being secured weldably to ring 22 within the inner circumference of the said ring and spaced thereabout. Each of the holder assemblies 32 includes a pair of outer holders 18 and a central or inner holder 18'. The outer holders 18 are fixedly secured as by welding, to the opposite ends 34 of a U-shaped metal rod 36. The central holder 18' is secured to one end 38 of elongate metal rod or stem 40. The rod 36 is secured permanently to the stem 40 as by welding at a location 44 between free end 42 and holder 18'. The stem 40 is secured to the ring 22 at a location adjacent its free end 42.

The holders 18 and 18' are generally conical and substantially identical, each holder being fabricated by rolling a planar metal sheet to a small diameter open bottom 46 and a wider mouth 48. If desired, one edge of the planar sheet may be bent, say at a right angle relative to the remaining sheet before rolling, so as to form inwardly directed flange 50 running along the length of the interior wall 52 of each holder 18,18'. Flange 50 serves as an aid in retaining the branch 20 within the holder 18,18', as the flange 50 is pressed tightly against the branch end when same is forced into the holder 18,18'.

The appropriate ends of the respective stem rods 36 and 40 are slipped into the bottom opening of the respective holders and welded thereto.

The tiers 14 are assembled and slipped onto the standard 12, and moved along the length thereof, the number of tiers 14 which are mounted to the standard being determined by the height of the display 10 desired. When located spaced along the length of the standard 12 the tiers 14 permanently are secured to the outer wall of the standard 12 by welding the crossbar 24 of each to said standard 12. The spacing between tiers may be uniform or non-uniform, the choice being one of design preference to assure the most stable assembly and depending also upon the type of flora being simulated.

The support base 16 includes a vertically oriented tubular member 54, the lower end 56 of which is secured permanently, as by welding, to a crossbar 58 itself weldably secured to a ring 60. The crossbar 58 is seated diametrically across the ring 60 resting thereupon. A pair of angular arranged brace members 62 weldably are secured to the ring 60 and to the tube member 54. The tube 54 is selected to have an inner diameter slightly larger than the outer diameter of the standard 12 so as telescopically to receive same.

The upper end of the display 10 is topped off by tier 64 of holders 18", each of holders 18" formed of an individual conical holder rolled from a sheet and secured permanently to a stem 66 and weldably secured about the inner circumference of a ring 22', carrying a crossbar 24'. One of the single holders 18" is secured directly to the top of the standard 12, said ring 22' also being secured to the top of the standard 12 by welding the crossbar 24' to said standard.

Each of the branches 20 preferably are substantially identical, although they need not be identical. Each branch 20 has one end 68 stripped of bark and if necessary, ground circumferentially to a desired diameter to enable facile insertion into the holders 18,18' and 18" by way of the wide mouths 48 thereof. The inwardly directed flange 50 tightly engages the prepared end 68 of the branch 20 and serves to firm the engagement of the branch end 68 within said holder.

The individual holders 18,18' and 18" may be oriented directionally as desired, although holders 18" preferably are oriented with their axes generally parallel to the axis of the standard 12. The holders 18 and 18' of the tiers 14 individually may be oriented angularly as desired by bending the stems relative to the rings 22 or bending the stems at their connection to the holders.

Preferably, the tier 14 located nearest the upper end of the standard 12 carries its individual holders angled the least relative to the axis of the standard. The tiers 14 located along the remaining length of the standard 12 may carry their holders 18 or holder assemblies 32 angled at progressively increasing angles depending upon the position of the particular tier along the length of the standard, the lowermost tier carrying holders oriented at the greater angles relative to the axis of the standard.

The placement of a branch 20 in each of the holders 18,18' and 18" result in a full, lifelike, naturally appearing tree simulating display.

The standard 12 may be formed of short tube lengths of progressively widening diameter, each carrying a tier 14 of holders. Accordingly, the foreshortened standards with tier may be assembled one onto the other progressively. In such instances, the simplest unit would consist of a short tubular standard carrying a ring having a plurality of holder assemblies secured thereto.

A modified embodiment of the invention is illustrated in FIG. 6 and differs from display 10 in that the display 10' was a solid rod 12' as a standard. The base 16' differs from base 16 in that base 16' is formed unitary with the rod 12'. The rod 12' is bent to define a triangular formation 70, the free end 72 thereof being weldably secured to the rod 12'. A second triangular member 74 having unitary sides 76 and a base 78 is secured to the rod 12' and to the formation 70, preferably disposed in a plane at right angle to the plane occupied by formation 70.

Referring to FIGS. 7 and 8, a modified tier 14' is represented as capable of being substituted for the tiers 14. Tier 14' differs from tier 14 in that a secondary support ring 22' is provided. The function of ring 22' is to provide additional support to the branch holders 18 or 18' in instances where the branches to be introduced therein into said holders are sufficiently heavy as to necessitate additional bracing support. The ring 22' is welded to the stems 40' of the holder assemblies or trident arrays 32 with the stems 40' disposed at the inner circumferential surface of the ring 22'. The connection, represented by reference character 80 is located just below the point of connection 82 forming the trident array 32. The individual holders 18 and/or 18' and their stems 40' experience more difficulty in experiencing custom angular orientation at will, but nevertheless still are capable of being bent, of course with more difficulty. Ordinarily the array of branch holders in the various tiers 14' are oriented angularly about the same to define similar conical flora patterns.

It should be understood that when all branches have been assembled in the respective holders, the holders themselves are effectively hidden by the foliage. The bottommost holders are so insignificant in respect of the overall visual effect that the full tree simulation is effective. The illustrations of the relative sizes of holders and branches have been somewhat exaggerated to explain the details of the construction.

Further, the term "holder" is not to be limited as used herein to the illustrated conical cup-like holder configuration. While said holders form the preferred assembly, variations are contemplated in the configuration and/or number of holders per unit assembly without departing from the spirit and scope of the invention.

The flora employed need not be limited only to natural or preserved natural flora alone. Artificial as well as the natural flora branch are useful so long as the stand and tiered holder arrangement are employed.

Variations are capable of being made in the details of the invention described herein without departing from the spirit or scope thereof as defined in the claims which follow.

What I claim is:

1. A flora simulative display comprising a standard, at least one tier of conical holders secured permanently along the length of said standard, a base having means for receiving said standard with the standard arranged vertically and the holders distributed about the circumference of said standard, each of said tiers including a ring and plural holders permanently secured thereto about the circumference thereof and a crossbar also secured to said ring, the standard passing through said ring and being permanently secured to said crossbar thereof, and plural branch members each having one end seated securely within a holder.

2. The display as claimed in claim 1 in which the holders comprise an open-mouthed conical tapered rolled member and a rod permanently secured thereto at the narrow end therof, the rod being secured permanently to said ring.

3. The display as claimed in claim 1 in which the tiers each comprise a plurality of holders arranged in a trident like configuration, the outer holders being secured to the ends of a U-shaped rod member and the inner holder being secured to a longer rod member, the bend of said U-shaped rod member being weldably secured to said longer rod member at a location between the inner holder and the free end of the longer member, the longer rod member being secured to said ring.

4. The display as claimed in claim 1 in which plural holders are secured to the ring about the inner circumference thereof.

5. The display as claimed in claim 1 in which each of the plural branch members comprise preserved natural foliage branch members.

6. The display as claimed in claim 1 in which said base includes a vertically oriented tubular member and brace means therefor, said tubular member being of diametric size and configuration telescopically to receive the lower end of said standard.

7. The display as claimed in claim 1 in which said standard and base are unitary.

8. The display as claimed in claim 3 and a top tier comprising individual holders, each having stems and being secured to a ring about the circumference thereof, said ring including a crossbar secured thereacross and to the upper end of the standard, the remaining tiers being spaced along the remaining length of the standard and each carrying plural trident configured holder assemblies.

9. The display as claimed in claim 8 wherein each tier carries its holders oriented at about the same angular relationship to the standard.

10. The display as claimed in claim 8 in which each tier carries its holders oriented at random angular relationship to the standard.

11. The display as claimed in claim 8 in which the angular orientation of the holders of a tier are similar but the tiers in order of their position along the standard carry the holders thereof at progressively increasing angular orientation.

12. The display as claimed in claim 1 in which the individual holders are capable of being variably oriented angularly relative to the standard.

13. The display as claimed in claim 1 in which at least one tier includes a secondary support ring fixedly secured thereabout and between the first ring and the base of the holders.

14. The display as claimed in claim 1 in which the holders are secured to the rings along the inner circumference of the ring.

15. The display as claimed in claim 13 in which substantially all tiers define a conical configuration flared at substantially the same angle.

* * * * *